US005359867A

United States Patent [19]

Ling et al.

[11] Patent Number: 5,359,867

[45] Date of Patent: Nov. 1, 1994

[54] COMBINATION PADLOCK WITH MAGNIFIABLE COMBINATIONS

[75] Inventors: Chong-Kuan Ling, Taipei, Taiwan, Prov. of China; Roger Pedlar, London, England

[73] Assignee: Samsonite Corporation, Denver, Colo.

[21] Appl. No.: 951,278

[22] Filed: Sep. 25, 1992

[51] Int. Cl.[5] ..... E05B 37/14

[52] U.S. Cl. ..... 70/28; 70/51; 70/53; 70/56; 70/312; 70/331; 70/446

[58] Field of Search ..... 70/22, 24, 25, 27–29, 70/51–56, DIG. 52, 331, 333 A, 312, 322, 443, 446; D8/334, 335

[56] References Cited

U.S. PATENT DOCUMENTS

| | | | |
|---|---|---|---|
| 688,491 | 12/1901 | Sigler | 70/DIG. 52 X |
| 839,795 | 12/1906 | Wilcox | 70/52 |
| 1,052,627 | 2/1913 | Takimoto | 70/28 |
| 1,123,886 | 1/1915 | Kaszewski | 70/27 |
| 1,293,879 | 2/1919 | Neumann | 70/29 |
| 1,449,923 | 3/1923 | Warnelo | 70/29 |
| 2,662,385 | 12/1953 | Zavoico | 70/52 |
| 3,863,468 | 2/1975 | Bach | 70/50 |
| 4,669,286 | 6/1987 | Cheng | 70/312 |
| 4,803,856 | 2/1989 | Ling | 70/28 |
| 4,866,959 | 9/1989 | Ling | 70/25 |
| 4,899,559 | 2/1990 | Chern | 70/25 |

FOREIGN PATENT DOCUMENTS

| | | | |
|---|---|---|---|
| 504466 | 8/1930 | Germany | 70/29 |

*Primary Examiner*—Lloyd A. Gall
*Attorney, Agent, or Firm*—Gregory W. O'Connor

[57] ABSTRACT

A combination padlock includes: a plurality of magnifying lenses juxtapositionally mounted on a lock body of the padlock with each lens projectively corresponding to each numeral formed on each dial so that the numeral formed on each dial can be magnified by each magnifying lens for a clear reading by a user's eyes; and a hasp pivotally mounted in a side portion of the lock body of the combination padlock having an arcuate hook member operatively lockable with a hasp socket recessed in a projecting portion extending upwardly sidewardly from the lock body in an opposite direction of the arcuate hook member of the hasp for locking an object or a staple within the hasp with a wider angular movement of the hasp. The lock can be conveniently operated with one hand to not only rotate the dials and lock and unlock the hasp, but also to move the hasp into its fully open or locked positions. The magnifying lenses are integrally formed with a transparent cover assembly which is locked around the lock body by a portion of the hasp.

15 Claims, 3 Drawing Sheets

COMBINATION PADLOCK WITH MAGNIFIABLE COMBINATIONS

BACKGROUND OF THE INVENTION

A conventional combination padlock includes a plurality of dials rotatably mounted in a housing of the padlock having arabic numbers annularly formed on each dial to be visually observed for unlocking or locking the lock. However, a small combination padlock such as for travel purposes may have a small volume or tiny space on the lock body to show the combination numerals on the dials, thereby causing a difficult or unclear observation for reading the small numbers printed on the dials and increasing the inconvenience for unlocking or locking the combination lock.

Also, conventional padlocks, whether operated by a combination mechanism or key typically include a "U" shaped hasp which is released from the lock body by the locking mechanism at one end of the "U" permitting the "U" shaped hasp to rotate about the fixed end so that the user can place the hasp through the article to be locked. The "U" shaped hasp is then rotated back into alignment with the lock body and the hasp is pushed home to lock it in place. These operations can be clumsy or cumbersome, sometimes requiring both hands to hold the lock, the hasp, and perhaps the articles to be locked to permit this locking and unlocking operation.

The lock in U.S. Pat. No. 4,866,959 shows a "U" shaped shackle 61 which moves linearly away from the lock body to expose a relatively narrow throat between the fixed shackle portion 11 and the opening end 611 of the movable shackle. While this simplified movement may enhance unlocking and locking the shackle 61, the relatively small space between the open ends of the fixed and movable shackle limit the size of the items which can be locked by the lock.

Also, conventional padlocks have a body portion that comprises an assembly of two or more parts to form a generally opaque and hopefully sturdy body to contain the combination or key operated tumbler mechanisms. Such lock bodies do not lend themselves to include written information, such as ownership information, as would normally be included on a "luggage tag" or the like. Hence, such a conventional combination lock, while it may work on a luggage piece, for example, would still require the user to identify the luggage with a separate luggage tag. It would be desirable for a luggage lock to also hold ownership information. It would be further desirable to have the luggage lock secure such ownership information so that only persons having the combination to open the lock can access or otherwise alter the information contained on the lock body.

BRIEF SUMMARY OF THE INVENTION

An object of the present invention is to provide a combination padlock including a plurality of magnifying lenses mounted directly on a lock body of the padlock with each lens projectively corresponding to each numeral formed on each dial so that the numeral formed on each dial can be magnified by each magnifying lens for a clear reading by a user's eyes, thereby enhancing a convenience for unlocking or locking the combination padlock.

Another object of the present invention is to provide a hasp pivotally mounted in a side portion of the lock body of the combination padlock having an arcuate hook member operatively lockable with a hasp socket recessed in a projecting portion extending upwardly sidewardly from the lock body in an opposite direction of the arcuate hook member of the hasp for locking an object or a staple within the hasp, thereby providing an easy unlocking or locking operation of the lock by pivoting the hasp about the side portion of the lock body with a wider angular movement of the hasp.

Another object of the present invention is to provide a lock body with a transparent cover portion received onto the lock body such that a slip of paper containing information can be trapped between a surface of the lock body and the transparent cover portion. It is a further object of the invention to provide a lock body and a transparent cover portion such that the transparent cover portion engages the lock body in a manner so that when the hasp portion of the lock is in an unlocked position, the transparent cover can be removed from the lock body for access to information underneath the transparent cover, and when the hasp portion of the lock is in a locked condition, the transparent cover portion is prevented from being removed from its position on the lock body.

DETAILED DESCRIPTION OF THE PREFERRED EMBODIMENT

Figure 1:
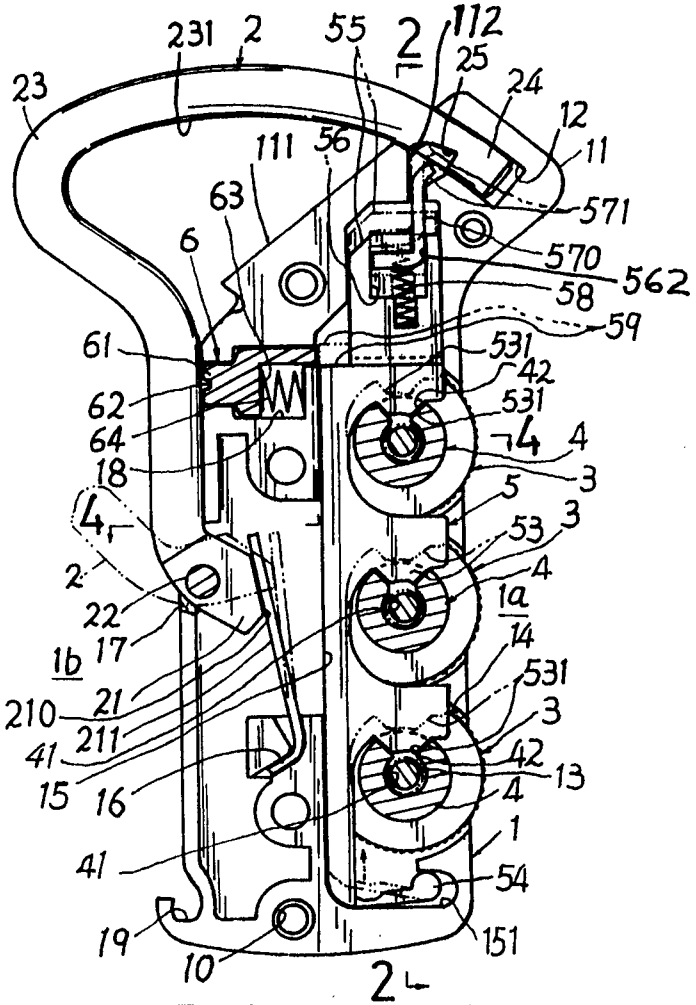
FIG. 1 is a front-view sectional drawing of the present invention.
Figure 2:
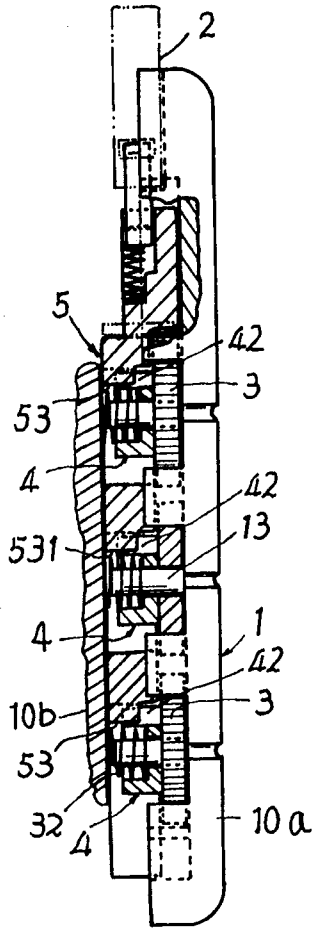
FIG. 2 is a longitudinal side-view sectional drawing of the present invention when viewed from 2—2 direction of FIG. 1.

As shown in the drawing figures, the present invention comprises: a lock body 1, a hasp 2, a plurality of dials 3 and sleeves 4, a sliding latch 5, a combination-changing means 6, a display means 7, and a transparent cover 8.

The locking body 1 includes: a pair of half shells 10*a*, 10*b* combined for forming the lock body 1 with rivets or other connecting means 10 for mounting all other elements of the present invention in the lock body 1, a projecting portion 11 protruding upwardly sidewardly from a first side portion 1*a* of the lock body 1 to form a staple-receiving portion 111 generally forming a sloping surface thereon. A hasp socket 12 is recessed in the projecting portion 11 for receiving the hasp 2, a plurality of stems 13 are mounted in the lock body 1 for respectively rotatably mounting the dials 3 and the sleeves 4 on the stems 13, with a plurality of dial slots 14 formed in a first side portion 10a of the lock body 1, with each slot 14 positioned for protruding the knurled edge of each dial 3 outwardly beyond the lock body 1 for dialing operation. A sliding groove 15 is recessed in the lock body 1 for slidably holding the sliding latch 5 in the sliding groove 15. The lock body further includes a positioning spring socket 16 formed in a lower portion of the lock body 1 for retaining a positioning spring 211 of the hasp 2, a hasp hole 17 formed in a second side portion 1*b* of the lock body opposite to the first side portion la for a pivotal movement of the hasp 2, and an anvil hole 18 formed in the lock body 1 for slidably holding the combination-changing means 6 in the anvil hole 18.

The hasp 2 includes: a base portion 21 pivotally mounted in the second side portion 1*b* of the lock body 1 by a pivot 22 and having frictional holding surfaces 210 circumferentially formed on an inner end portion of the base portion 21 to be resiliently held by the positioning spring 211 secured in the spring socket 16 of the lock body 1 either at a locked state or unlocked state (dotted line) as shown in FIG. 1. An arcuate hook member 23 protrudes upwardly and sidewardly from the second side portion 1*b* of the lock body 1 on a side opposite to the projecting portion 11 and then bends inwardly and downwardly to form a hook shape and having a locking bolt portion 24 connected with the hook member 23 and engageable with the hasp socket 12 in the projecting portion 11. The bolt portion 24 has a bolt notch 25 recessed in an inner lower end portion of the bolt portion 24 which is engageable with a locking pin 57 of the sliding latch 5 to lock the locking bolt portion 24 in the hasp socket 12 of the lock body 1. The arcuate hook member 23 operatively defines a locking space 231 in cooperation with the staple-receiving portion 111 of the projecting portion 11 for locking a staple or an object to be locked (not shown) in the space 231. Note that the main portion of the hasp between the hooked portion 23 and the bolt portion 24 has a generally smoothly curving arcuate shape. This shape is along a section of a circle whose center corresponds to pivot 22. In this way, the hasp can be pivoted about the pivot 22 and the main portion of the hasp easily passed through a staple, link in a chain, etc. as it moves in its arc. As will be further detailed, this permits one hand operation of the lock and eliminates the clumsy operation of the conventional hasp of a conventional padlock type lock.

Each sleeve 4 includes: a central hole 41 formed through the sleeve 4 for rotatably mounting the sleeve 4 on each stem 13 and urged by a tensioning spring 32 retained in the lock body 1 for resiliently coupling each sleeve 4 with each dial 3 for a coupled rotation of each dial 3 coupled with each sleeve 4. The contacting surfaces of each sleeve 4 and its mating dial 3 include conventional inter-engaging bumps and depressions (not shown) at their mutually contacting surfaces. These assure that each sleeve and dial assembly stay fixed relative to one another during normal locking and unlocking operations. However, for resetting the locking combination, these parts can be made to move relating to one another. This resetting will be detailed below with regard to the resetting anvil 61. A sleeve notch 42 tapered or converged inwardly towards a center of the sleeve 4 is engageable by a tapered extension 53 protruding downwardly in the sliding latch 5 slidably held in the lock body 1. The sleeve notch 42 has a pair of inner sloping surfaces 421 operatively engageable with two outer sloping surfaces 531 disposed on two opposite sides of the tapered extension 53 of the sliding latch 5, thereby allowing the two inner sloping surfaces 421 of the sleeve notch 42 to operatively thrust the two outer sloping surfaces 531 of the tapered extension 53 upwardly to move the sliding latch 5 upwardly to engage the locking pin 57 (FIG. 5) of the sliding latch 5 with the bolt notch 25 of the hasp 2 for locking purpose.

Figure 5:
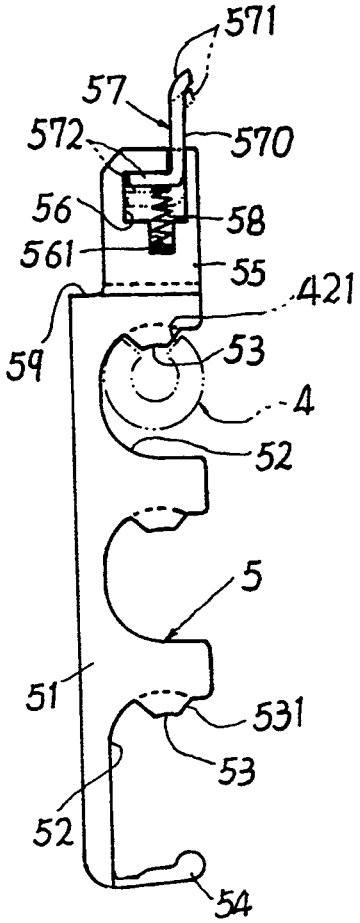
FIG. 5 shows a sliding latch of the present invention.

The sliding latch 5 as shown in FIGS. 5 and 1 includes: a sliding plate 51 slidably held in the sliding groove 15 in the lock body 1, a plurality of sleeve recesses 52 longitudinally recessed in the sliding plate 51 for holding each sleeve 4 within each sleeve recess 52, each sleeve recess 52 having a tapered extension 53 tapered downwardly from an upper peripheral edge portion of each recess 52 defining a pair of outer sloping surfaces 531 on two opposite sides of the tapered extension 53 engageable with each sleeve notch 42 of each sleeve 4 for unlocking the padlock, a bottom spring 54 integrally formed with a lower portion of the sliding plate 51 and retained in a bottom spring socket 151 in the lock body 1 for normally pulling the sliding plate 51 downwardly in the lock body 1 for operatively engaging each tapered extension 53 with each sleeve notch 42 of each sleeve 4 as shown in full line of FIG. 1. The locking pin 57 is slidably held in a pin socket 56 formed in a pin-holding portion 55 on an upper portion of the sliding plate 51 and operatively engageable with the bolt notch 25 of the hasp 2 when it is upwardly urged by a pin-restoring spring 58 retained in a spring recess 561 formed in the pin-holding portion 55 communicated with the pin socket 56. A shoulder portion 59 is intermediate the pin-holding portion 55 and the sliding plate 51 and facing the combination-changing means 6 to be depressible by the needle anvil 61.

FIG. 5 shows the slide plate 51 in greater detail. The locking pin 57 as shown includes: a straight pin portion 570 projecting upwardly through a lower pin opening 562 and an upper pin opening 112 respectively formed in the pin-holding portion 55 and in the projecting portion 11 of the lock body 1, a hook-shaped tip portion 571 slightly bent towards the first side portion 1*a* of the lock body 1 for engaging the bolt notch 25 of the hasp 2. A pin base 572 is secured on a bottom portion of the straight pin portion 570 and is retained by the pin-restoring spring 58 for normally urging the locking pin 57 upwardly.

Figure 3:
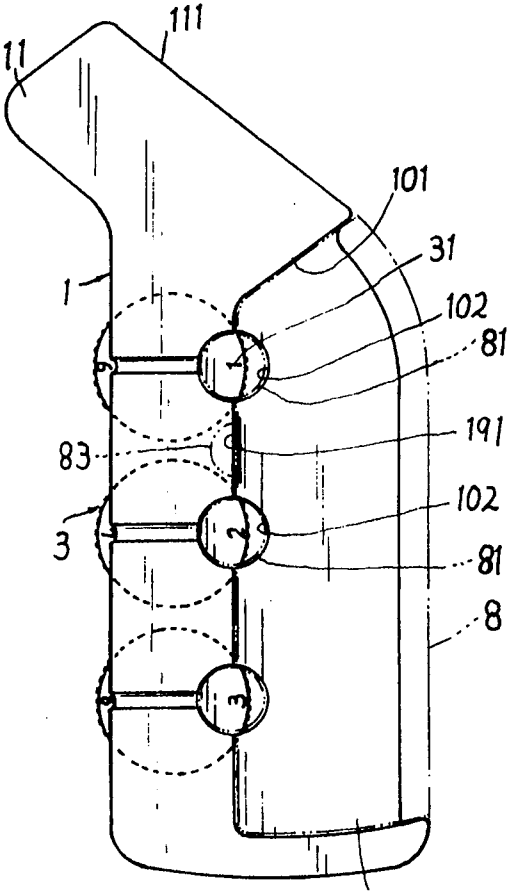
FIG. 3 is an illustration of the lock body of the present invention.
Figure 4:
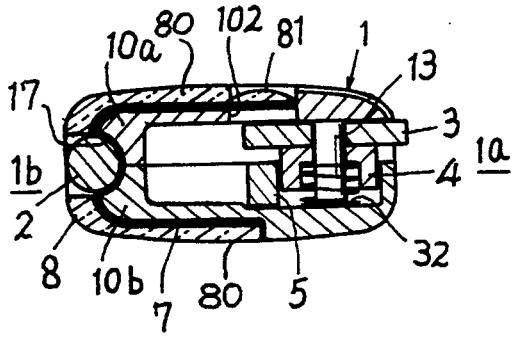
FIG. 4 is a cross sectional drawing of the present invention when viewed from 4—4 direction of FIG. 1.
Figure 9:
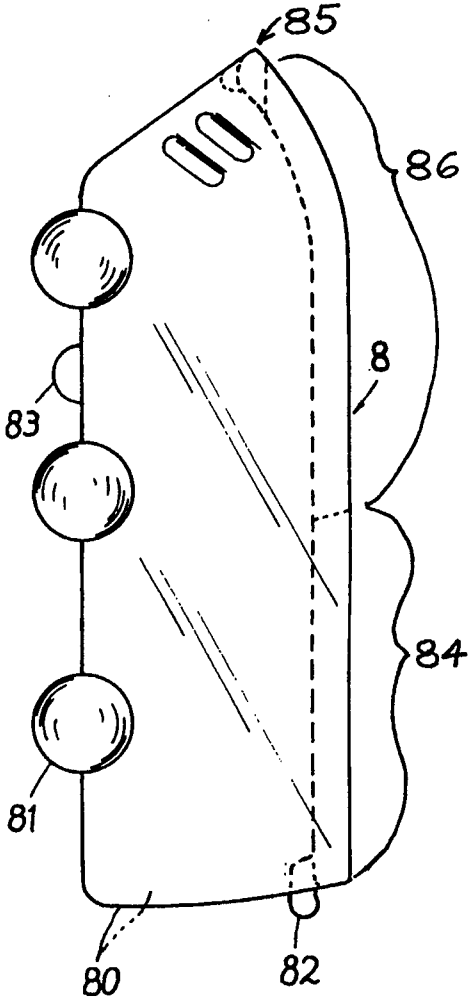
FIG. 9 hows a transparent cover of the present invention.
Figure 8:
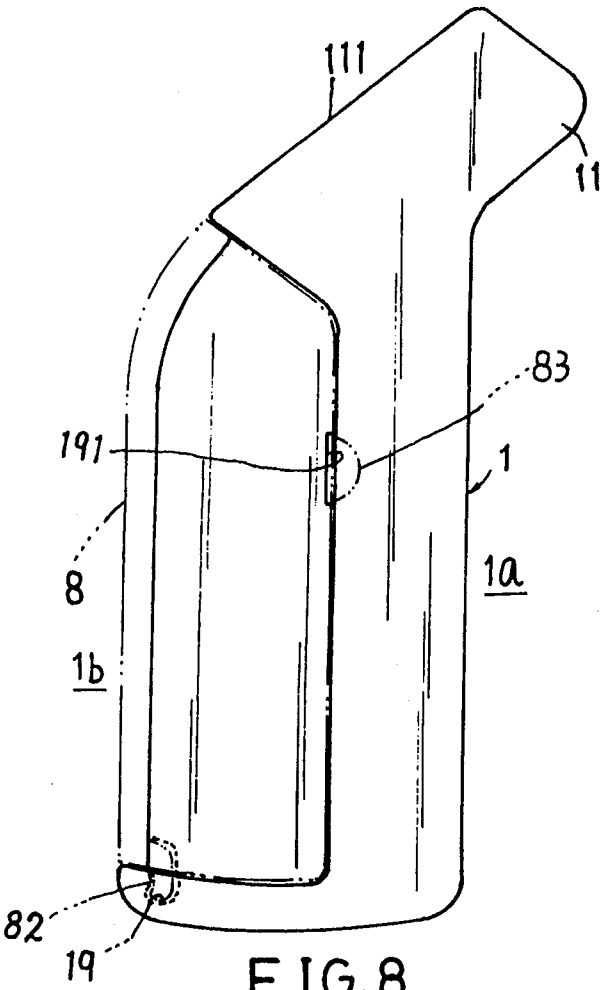
FIG. 8 shows a reverse side of FIG. 3.

The transparent cover 8 as shown in FIGS. 9, 8 and 3, and in cross sectional view FIG. 4, includes: a pair of transparent clamping flaps 80 engageable within a pair of cover sockets or depressions 101 in the two half shells 10*a*, 10*b* of the lock body 1 for covering the lock body 1. A plurality of magnifying lenses 81 are formed longitudinally along an edge of at least one transparent clamping flap 80. Each lens 81 aligns with one numeral 31 on a dial 3. The lenses magnify the numerals through each inspection window 102 formed through a half shell 10*a* of the lock body 1. A bottom lug 82 formed on a bottom interconnecting portion 84 of the cover 8 between each flap 80 engages a bottom-lug recess 19 formed in the lock body 1 at the bottom most edge of the depressions 101. An upper lug 83 formed on an upper edge portion of each flap 80 engages with an upper-lug recess 191 formed in each half shell of the lock body 1 of the transparent cover 8 to detachably mount the transparent cover on the lock body 1. Upper interconnecting portion 85 retains flaps 80 together at their uppermost corners. The hasp 2 passes through the resulting opening 86 between the interconnecting portions 84 and 85 and the flaps 80. When the locking bolt portion is locked into cavity 12 (as in FIG. 1), the transparent cover 8 is held in place.

Figure 7:
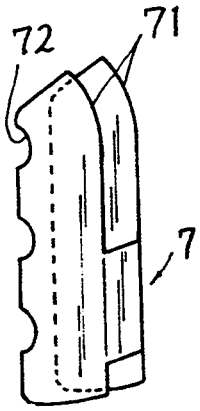
FIG. 7 is a perspective view showing a display means of the present invention.

The display means 7 as shown in FIG. 7 includes: a pair of leaves 71, each leaf 71 corresponding to each flap 80 of the transparent cover 8 and normally clamped in between each half shell of the lock body 1 and the cover 8. At least one leaf 71 has a plurality of arcuate cutouts 72 disposed about a contour of each lens 81 to thereby prevent blocking the numerals on the dials 3. The leaf 71 can be made of paper or plastic sheet or other thin plates for printing or writing the user's name, or a logo, trademark, advertisement for display, identification, or advertisement purposes.

Figure 6:
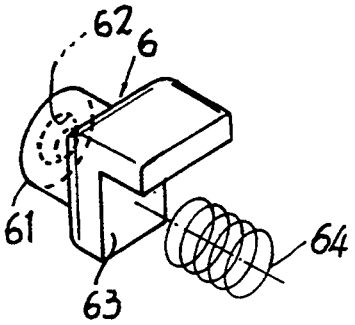
FIG. 6 a perspective view of a combination-changing means of the present invention.

The combination-changing means 6 as shown in FIG. 6 includes: a needle anvil 61 secured with a spring retaining block 63 to be slidably held in an anvil hole 18 formed in the lock body 1. An indentation 62 formed in the needle anvil 61 is to receive a needle or needle-like object insertable therein when the hasp 2 is in the unlocked position (as shown in phantom in FIG. 1). An anvil restoring spring 64 is retained in the anvil hole 18 and normally urges the spring retaining block 63 and the needle anvil 61 outwardly towards the second side portion 1*b* of the lock body 1.

The spring retaining block 63 is generally L-shaped for depressibly engaging a shoulder portion 59 of the sliding latch 5 for "locking" an engagement of each sleeve 4 with the sliding latch 5 in order for combination changing operation.

When unlocking the padlock of the present invention, the dials 3 are rotated to an opening combination, turning the sleeves 4 to allow each sleeve notch 42 to match with each tapered extension 53 of the sliding latch 5. The bottom spring 54 of the sliding latch 5 will urge the sliding plate 51 downwardly to engage each sleeve notch 42 with each extension 53 of the sliding latch to thereby retract the locking pin 57 and to disengage the locking pin from the bolt notch 25 of the hasp 2 so that the hasp 2 may be pivoted to open the padlock.

For locking the present invention, the dials 3 and the coupled sleeves 4 are rotated to allow two inner sloping surfaces 421 (FIG. 5) of each sleeve 4 to thrust the two outer sloping surfaces 531 of each tapered extension 53 of the sliding latch 5 upwardly as shown in FIG. 1 in phantom thereby pushing the sliding latch 5 and the locking pin 57 upwardly and causing an engagement of the locking pin 57 with the bolt notch 25 of the hasp 2 when moved inwardly towards the hasp socket 12 for locking the padlock. Since the locking pin 57 is biased by spring 58, the locking bolt portion 24 when inserted into the socket 12 will first depress the pin 57 downwardly. Then the bolt notch 25 is engaged by the pin 57 which is urged upwardly by the spring 58 retained in the socket 56 and the holding portion 55 of the sliding latch 5. Thus, the locking bolt portion 24 is firmly locked in the socket 12 unless the lock is unlocked.

If the present invention is unlocked, and the dials 3 are accidentally rotated to change their unlocked combination to a locked combination, the sleeves 4 will thrust the sliding latch 5 upwardly to move the locking pin 57 upwardly, projecting it into the socket 12, whereby upon a depression of the hasp 2 towards the socket 12 to engage the notch 25 with the pin 57, the hasp 2 will be locked in the lock body 1. This is an improvement of the present invention over a conventional padlock, because when the dials of a conventional padlock are accidentally rotated from an unlocked combination to a locked combination, the shackle can not be locked into a shackle hole in a lock body until the dials are rotated to their unlocked combination. Also, in the conventional lock, after the shackle is closed in the lock body, the dials should be further rotated to a locked combination for locking the lock, thereby causing inconvenience and being inferior to this invention.

When changing the combination of the present invention when unlocked and the hasp 2 is pivotally moved outwardly as shown in dotted line of FIG. 1, a needle or needle-like object is inserted into the depression 62 to push the anvil 61 inwardly to allow the L-shaped spring retaining block 63 to engage the shoulder portion 59 of the sliding latch 5. The sleeves 4 are firmly engaged by the latch 5 and will not rotate. The dials can now be rotated relative to their respective sleeves to a new number combination thus "resetting" or changing the combination.

The present invention provides a padlock with the dial numerals magnifiable for a clear easier observation by a lock user. Also, the display means 7 provides a space for printing name, logo or advertisement features thereon to increase its commercial value. The hasp 2 pivotally mounted on a side portion of the padlock renders a wider angular unlocking or locking movement of the hasp for a very convenient and ergonomic operation of the present invention to be superior to any conventional combination locks.

Accordingly, the lock of the instant invention provides many advantages over the conventional hasp type padlock, and solves many problems heretofore unanticipated. For example, unlike most other padlocks with a body or case to which a rotating shackle or hasp is attached, the inventive lock can be operated easily with one hand. The hasp 2 can be pivoted to a wide open position about axle 22 when the lock is in an unlocked combination position. One need only overcome the slight restoring force of the spring 211 on the cam-like surfaces 210. Once open, the hasp 2 will be held in the open position until again the slight stabilizing force of the spring 211 is overcome. At that point, the hasp 2 will swing easily into the cavity 12 after overcoming the slight spring force of the locking pin restoring spring 58. This closing operation can easily be done with a slight thumb or index finger pressure on the portion 23 of the hasp 2. The overall shape of the lock body 1 also lends to this thumb or finger pressure operation.

The location of hasp axle 22 well down along the length of the body 1 creates a relatively long rotational radius through which the curving loop portion 231 of hasp 2 moves between its open and closed positions. Note that the radius of curvature of portion 231 approximates the arc through which this curving loop moves between its open and closed positions. This permits the hasp 2 to be easily threaded through a relatively small opening in a doorbolt, zipper pulltab, bicycle chain, etc.

The advantages provided by the transparent cover with its magnifying lenses 81 are quite apparent from the subject disclosure. The transparent cover 8 itself adds to the security and utility of the lock since once the hasp 2 is rotated in the open position, it can be slid from its position in depressions 101 and thus give the user access to the display means 7. In this way the user can write or change the identifying indicia thereon. Such identifying indicia could include the users name, address, emergency telephone number, the locker or location of the lock to be secured by the subject padlock. Once the hasp 2 is secured in this lock position, however, unauthorized removal of the transparent cover is prevented through the combination of the protrusions or detents 82 and 83 and the trapping of the cover by the elongated portion of the hasp where the hasp passes through the transparent cover near the needle anvil 61.

We claim:

1. A padlock comprising: a lock body, a projecting portion protruding upwardly from a first side portion of said lock body having a hasp socket formed in the projecting portion; a hasp pivotally mounted in a second side portion of said lock body opposite to said projecting portion of said lock body and operatively engageable with said hasp socket for locking said hasp in said hasp socket; a latch slidably held in said lock body for locking said hasp in said hasp socket for locking said padlock; said padlock further includes a plurality of dials rotatably mounted in said lock body having a plurality of numerals annularly formed on each said dial; and a transparent cover which engages a portion of said lock body, said hasp engaging said transparent cover when said hasp is locked in said socket whereby unintended removal thereof is prevented, and when said hasp is pivoted to another position said transparent cover is released from said engaging with said hasp.

2. A padlock according to claim 1, wherein said transparent cover includes means for magnifying said numerals on said dials, a pair of transparent flaps engageable with a pair of cover sockets recessed in two half shells combinably forming the lock body.

3. A padlock according to claim 2, wherein said transparent cover includes a bottom lug formed on a bottom portion thereof engageable with a bottom-lug recess formed in said lock body, and an upper lug formed on an upper portion of said cover engageable with an upper-lug recess formed in said lock body, all said lugs being detachably mounted to the lock body.

4. A padlock according to claim 2, wherein said lock body includes: a pair of half shells combined for forming the lock body, said projecting portion protruding upwardly and sidewardly from the lock body to form a staple-receiving portion having a generally sloping surface thereon, said hasp socket recessed in the projecting portion for receiving the hasp, a plurality of stems mounted in the lock body for respectively rotatably mounting the dials on the stems, a plurality of dial slots formed in said first side portion of the lock body for protruding each said dial outwardly beyond the lock body for dialing operation, and a sliding groove longitudinally recessed in the lock body for slidably holding the sliding latch in the sliding groove, a positioning-spring socket formed in a lower portion of the lock body for retaining a positioning spring of the hasp, a hasp hole formed in said second side portion of the lock body for a pivotal movement of the hasp, and an anvil hole formed in the lock body for slidably holding a combination-changing means in the anvil hole.

5. A padlock according to claim 4, further including a sleeve resiliently coupled to each said dial, and wherein each said sleeve includes: a central hole formed through the sleeve for rotatably mounting the sleeve on one of said stems and urged by a tensioning spring retained in the lock body for resiliently coupling each said sleeve with each said dial for a coupled rotation thereof, each said sleeve including a sleeve notch converging inwardly towards a center of the sleeve to be engageable with a tapered extension protruding downwardly in the sliding latch slidably held in the lock body, said notch having a pair of inner sloping surfaces operatively engageable with two outer sloping surfaces disposed on two opposite sides of the tapered extension of the sliding latch, thereby allowing the two inner sloping surfaces of the sleeve notch of the sleeve to operatively thrust the two outer sloping surfaces of the tapered extension of the latch upwardly to lock said hasp in said hasp socket.

6. A padlock according to claim 5, wherein said sliding latch includes: a sliding plate slidably held in said sliding groove in the lock body, a plurality of sleeve recesses longitudinally recessed in the sliding plate for holding each said sleeve within each said sleeve recess, each said tapered extension tapered downwardly from an upper peripheral edge portion of each said sleeve recess, a bottom spring integrally formed with a lower portion of the sliding plate and retained in a bottom spring socket in the lock body for normally pulling the sliding plate downwardly in the lock body for engaging each said tapered extension with each said sleeve notch of each said sleeve, a locking pin slidably held in a pin socket formed in a pin-holding portion on an upper portion of the sliding plate and operatively engageable with a bolt notch formed in the hasp as upwardly urged by a pin-restoring spring retained in a spring recess formed in the pin-holding portion communicated with the pin socket, and a shoulder portion intermediate the pin-holding portion and the sliding plate.

7. A padlock according to claim 6, wherein said locking pin includes: a straight pin portion projecting upwardly through a lower and an upper pin opening respectively formed in the pin-holding portion and in the projecting portion of the lock body, a hook-shaped tip portion formed on a top portion of the straight pin portion slightly bent towards the first side portion of the lock body for engaging the bolt notch of the hasp, and a pin base secured on a bottom portion of the straight pin portion said pin-restoring spring engaging said pin base for normally urging the locking pin upwardly.

8. A padlock according to claim 4, wherein said combination-changing means includes: a needle anvil secured with a spring retaining block to be slidably held in said anvil hole formed in the lock body, a needle hole formed in the needle anvil to be depressed by a needle or needle-like object insertable through said hasp hole when the hasp is in an unlocked state, and an anvil restoring spring retained in the anvil hole normally urging the spring retaining block and the needle anvil outwardly towards the second side portion of the lock body ready for a depression on the anvil.

9. A padlock according to claim 2, wherein a display means is trapped in between said cover and said lock body, said display means including: a pair of leaves, each leaf corresponding to each said flap of the transparent cover and sandwiched in between each half shell of the lock body and each said flap of the cover, each said leaf selected from: a paper sheet, a plastic sheet, and thin plates for printing display features thereon.

10. A padlock according to claim 9, wherein said cover and said display means are detachably mounted on said lock body.

11. A padlock according to claim 1, wherein said hasp includes: a base portion pivotally mounted in said second side portion of the lock body by a pivot and having a frictional holding surface circumferentially formed on an inner side portion of the base portion to be resiliently held by the positioning spring secured in the spring socket of the lock body at a locked state or an unlocked state, an arcuate hook member protruding upwardly and sidewardly from the second side portion of the lock body in an opposite direction to the projecting portion and then bent inwardly and downwardly to form an arcuate shape, a locking bolt portion connected and engageable with the hasp socket in the projecting portion and having a bolt notch recessed in a lower end portion thereof, said bolt notch engaging a locking pin on the sliding latch when locking the locking bolt portion in the hasp socket of the lock body, the arcuate hook member operatively defining a locking space in cooperation with the staple-receiving portion of the projecting portion for locking a staple therein.

12. A padlock as set forth in claim 1, wherein said transparent cover includes means for magnifying said numerals on said dials for a clear observation of said numerals on said dials.

13. A combination padlock comprising: a lock body, a projecting portion protruding upwardly sidewardly from a first side portion of said lock body having a hasp socket formed in the projecting portion; a hasp pivotally mounted in said lock body and operatively engageable with said hasp socket for locking said hasp with said hasp socket; wherein said hasp includes a base .portion pivotally mounted in a second side portion of the lock body by a pivot and having a frictional holding surface circumferentially formed on an inner side portion of the base portion, a positioning spring secured in the lock body and positioned to engage said frictional holding surface such that said hasp is urged by said spring to a locked position or an unlocked position, said hasp further includes an arcuate hook member protruding first upwardly and sidewardly from the second side portion of the lock body in an opposite direction to the projecting portion, and then bent inwardly and downwardly to form a main portion having an arcuate shape with a radius of curvature which approximates the arc through which said main portion moves when said hasp moves between said unlocked position and said locked position whereby said main portion of said hasp can be easily threaded through an opening.

14. A padlock as set forth in claim 13 further including a plurality of dials rotatably mounted in said lock body having a plurality of numerals annularly formed on each said dial, each said dial resiliently coupled with a sleeve thereon, said dials and said sleeves being operatively rotated to lock said hasp in said hasp socket for locking said padlock.

15. A padlock as set forth in claim 14 further including a means mounted on said lock body for magnifying said numerals on said dials for a clear observation of said numerals on said dials.

* * * * *